United States Patent [19]

Long et al.

[11] 4,447,198

[45] May 8, 1984

[54] HYDRAULIC REFRACTORY PRESS INCLUDING PRODUCT THICKNESS OR DENSITY CONTROL MEANS

[75] Inventors: Gary R. Long, Bolingbrook; Robert J. Dorsey, Chicago, both of Ill.

[73] Assignee: Wehr Corporation, Milwaukee, Wis.

[21] Appl. No.: 436,699

[22] Filed: Oct. 26, 1982

[51] Int. Cl.[3] ..... B30B 15/16

[52] U.S. Cl. ..... 425/140; 425/141; 425/150; 425/352; 425/415

[58] Field of Search ..... 425/78, 162, 167, 139, 425/149, 150, 411, 415, 422, 352, 354, 355, 140, 141

[56] References Cited

U.S. PATENT DOCUMENTS

| | | | |
|---|---|---|---|
| 1,246,722 | 11/1917 | Curd | 425/354 X |
| 2,508,301 | 5/1950 | Stacy | 425/411 X |
| 2,825,092 | 3/1958 | Hatch et al. | 425/78 |
| 2,946,091 | 7/1960 | Fraula et al. | 425/139 |
| 3,078,540 | 2/1963 | Bush | 425/78 |
| 3,132,379 | 5/1964 | Crane | 425/78 |
| 3,191,232 | 6/1965 | Haller | 425/78 |
| 3,447,205 | 6/1969 | Dorsey | 425/422 X |
| 3,487,507 | 1/1970 | Turk | 425/29 |
| 3,758,245 | 9/1973 | Hermes | 425/150 X |
| 3,816,052 | 6/1974 | Shoppee et al. | 425/352 X |
| 3,868,201 | 2/1975 | Jacobson et al. | 425/78 |
| 3,893,792 | 7/1975 | Lacsko | 425/149 |
| 4,000,231 | 12/1976 | Peterson | 425/78 X |
| 4,195,048 | 3/1980 | Jung | 425/139 X |
| 4,260,346 | 4/1981 | Anderson et al. | 425/352 X |
| 4,265,610 | 5/1981 | Dorsey | 425/411 |
| 4,269,580 | 5/1981 | Wright | 425/150 |
| 4,270,890 | 6/1981 | Ottl | 425/150 |
| 4,289,472 | 9/1981 | Dorsey | 425/422 X |
| 4,373,889 | 2/1983 | Brown | 425/150 |
| 4,392,800 | 7/1983 | Apuzzo | 425/78 |

*Primary Examiner*—J. Howard Flint, Jr.

[57] ABSTRACT

A hydraulic press is provided including a frame having a pair of spaced-apart vertical side members and a crown, and a mold box rigidly supported between the vertical side members and including a vertical mold cavity. A lower plunger assembly is positioned below the mold box and includes at least one plunger adapted to extend upwardly into the mold cavity, and an ejection cylinder assembly is provided for causing selective vertical movement of the lower plunger assembly. An upper plunger assembly is positioned above the mold box and includes an upper plunger adapted to extend downwardly into the mold cavity, and a hydraulic ram is provided for supporting the upper plunger assembly for vertical movement with respect to said mold box and with respect to said lower plunger assembly. The hydraulic ram includes a cylinder fixed to the lower plunger assembly and a ram housed in the cylinder and adapted to selectively drive the upper plunger assembly downwardly. Rack and pinion position encoders are provided for sensing the relative movement of the lower plunger assembly and the upper plunger assembly and for generating electrical signals indicating such relative movement so as to provide accurate control of the size of the compressed refractory product. Pressure transducers are also provided and function to permit control of the compression pressure and the density of the resultant products.

18 Claims, 4 Drawing Figures

10
12
14
16
18
20
22
24
30
32
34
36
38
40
42
44
45
46
48
50
52
54
56
60
62
64
66
68
70
72
74
76
78
80
81
82
83
84
85
86
88

HYDRAULIC REFRACTORY PRESS INCLUDING PRODUCT THICKNESS OR DENSITY CONTROL MEANS

FIELD OF THE INVENTION

The present invention relates to presses of the type for use in compressing refractory material such as are used in making bricks, and more particularly relates to hydraulic presses for such use.

BACKGROUND OF THE INVENTION

Prior art refractory presses commonly include a rigid frame having a mold table supported by the frame for vertical movement. An example of a typical prior art refractory brick press is illustrated in the U.S. Dorsey Pat. Nos. 3,447,205, and 4,265,610. In such brick presses the mold table fixedly supports a mold box having a plurality of vertical mold cavities, and a lower plunger assembly is fixed to the frame and includes a plurality of plungers adapted to project upwardly into the mold cavities. Such presses also commonly include an upper plunger assembly including a plurality of downwardly extending plungers, and a ram is provided to cause downward movement of the upper plunger assembly so that refractory material in the mold cavities can be compressed between the upper and lower plungers.

Such prior art refractory presses also commonly include toggle press arrangements or friction press mechanisms for providing compressive movement of the plunger assemblies. Using these prior art structures and conventional techniques, bricks or other refractory products are made on a size control basis. More particularly, the press plungers are shimmed until a brick of the proper size is produced. If the brick is of the density required by the operator, the operator will assume that the pressure generated by the toggle press or friction press is satisfactory. It will be appreciated that consistency in the quality of bricks produced using the prior art apparatus requires the same quantity of fill be put into the mold cavity during each cycle of the press. If too little refractory material is added, then the resultant brick will not have the required density.

SUMMARY OF THE INVENTION

The present invention provides an improved press for use in making compressed refractory products, the press including hydraulically driven press rams and means for controlling the operation of the hydraulic rams such that the press can produce bricks having a predetermined thickness and wherein the density of the brick is held within predetermined limits or wherein the resultant product will have a predetermined density with the product having a size held within controlled limits.

More particularly, the invention includes a hydraulic press comprising a frame, a mold box supported by the frame and including at lease one vertically extending mold cavity, and a lower plunger assembly positioned below the mold box and including a plunger adapted to extend upwardly into the mold cavity. An upper plunger assembly is positioned above the mold box and includes a plunger adapted to extend downwardly into the mold cavity, and means are also provided for causing selective vertical movement of the upper plunger assembly with respect to the mold box and the lower plunger assembly, this means including a ram and a cylinder. Means are also provided for sensing the relative movement of the lower plunger assembly and the upper plunger assembly, the means for sensing including means for generating a signal indicating the relative position of the upper plunger assembly and the lower plunger assembly. The hydraulic press also includes means for sensing the pressure in the cylinder.

The invention also includes a hydraulic press comprising a frame including a pair of spaced-apart vertical side members and a crown, and a mold box rigidly supported between the vertical side members, the mold box including at least one vertically extending mold cavity. A lower plunger assembly is positioned below the mold box, the lower plunger assembly including at least one plunger adapted to extend upwardly into the mold cavity, and means are also provided for causing selective vertical movement of the lower plunger assembly, this means including an ejection cylinder assembly. An upper plunger assembly is positioned above the mold box and includes at least one upper plunger adapted to extend downwardly into the mold cavity, and means are further provided for supporting the upper plunger assembly for vertical movement with respect to the mold box and with respect to the lower plunger assembly, the means for supporting including a hydraulic cylinder, means for fixedly connecting the hydraulic cylinder to the lower plunger assembly, and a ram housed in the cylinder and adapted to selectively drive the upper plunger assembly downwardly. Means are further provided for sensing the relative movement of the lower plunger assembly and the upper plunger assembly, the means for sensing including means for generating a signal indicating the relative position of the upper plunger assembly and the lower plunger assembly. The hydraulic press also includes means for sensing the pressure in the cylinder.

In a preferred embodiment of the invention the means for sensing relative movement includes a first rack and pinion position encoder including a pinion, a rack, and means for producing an electrical signal in response to relative movement of the rack and pinion, one of the rack and the pinion being connected to the frame and the other of the rack and the pinion being connected to the lower plunger assembly.

In a preferred form of the invention the means for sensing further includes a second rack and pinion position encoder including a pinion, a rack, and means for producing an electrical signal in response to relative movement of the rack and pinion, one of the rack and pinion of the second rack and pinion being connected to the upper plunger assembly and the other of the rack and pinion of the second rack and pinion position encoder being connected to the hydraulic cylinder.

In another preferred embodiment of the invention the means for sensing the pressure includes a pressure transducer including means for producing an electrical signal proportional to the pressure in the cylinder.

Various other features and advantages of the invention will be apparent from reference to the following description of a preferred embodiment from the claims, and from the drawings.

Figure 1:
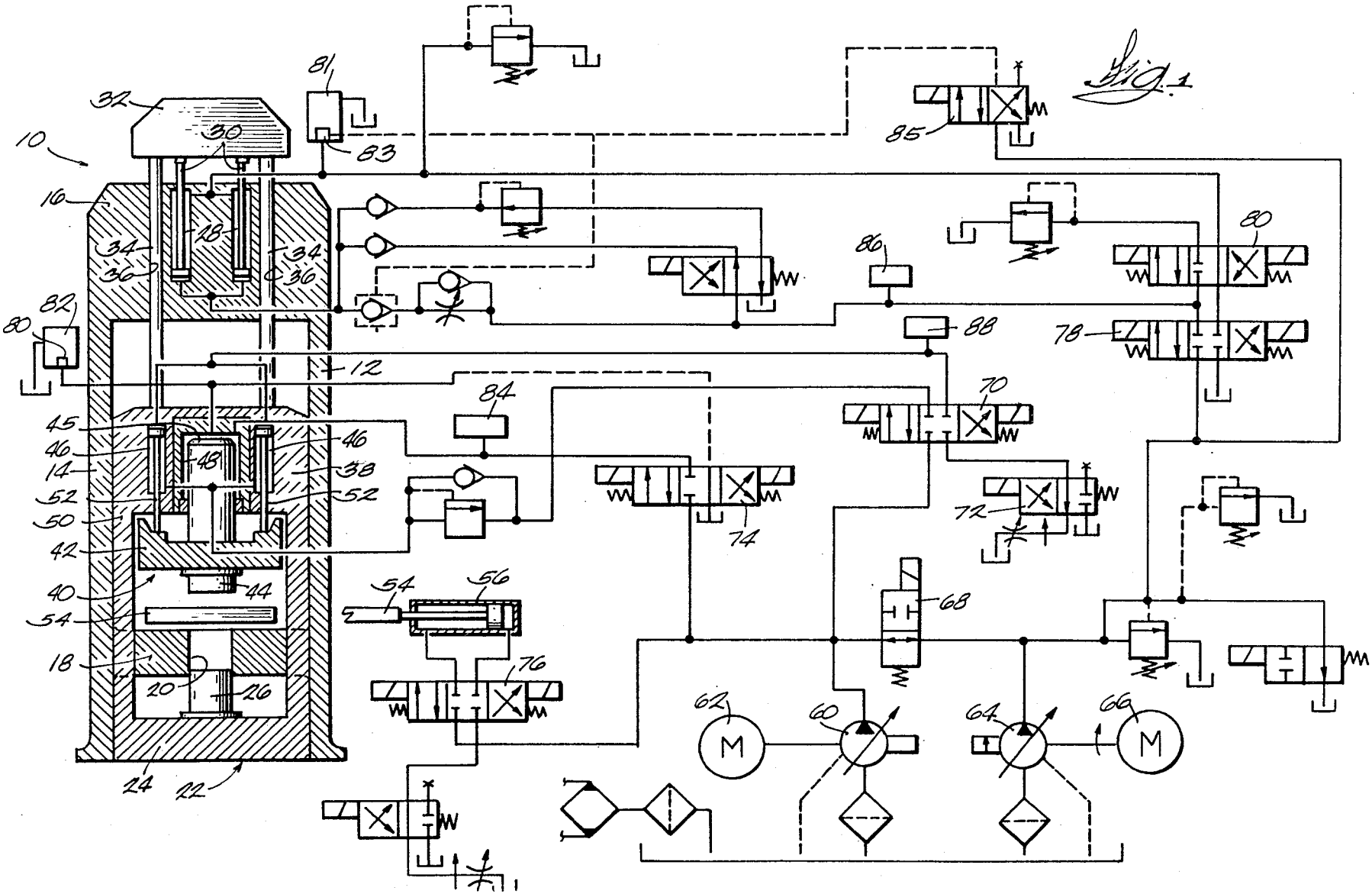
FIG. 1 is a schematic elevation view of a hydraulic press embodying the invention and a schematic illustration of the hydraulic circuitry of the press.

Before describing the preferred embodiments of the invention in detail, it is to be understood that the invention is not limited in its application to the details of construction or arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

The present invention includes a press 10 for refractory material having an improved arrangement for providing compression of the refractory material in the mold cavity. More specifically, the press 10 which is illustrated schematically in FIG. 1, includes a hydraulic ram arrangement providing for movement of both the upper and lower plungers into compressive engagement with refractory material contained in the mold cavities of a fixed mold box by providing controlled movement of both the upper and lower plunger assemblies. The refractory material in the mold cavities can be compressed in a manner which provides more uniform density of the resultant refractory product and also permits control of the compression of the refractory product to permit the press operator to control the product density of the brick.

More particularly, the press apparatus embodying the invention includes a frame 12 comprised of a pair of vertical side members 14 joined at their upper ends by a crown 16. A mold table 18 is fixedly supported by the vertical side members 14 and the mold table 18 supports a mold box, the mold box including at least one vertical mold cavity 20 open at its upper and lower ends. A lower plunger assembly 22 is positioned beneath the mold table 18 and includes a lower crosshead 24 supporting at least one plunger 26 adapted to extend upwardly into the mold cavity 20.

Means are also provided for causing selective vertical movement of the lower plunger assembly 22. In the illustrated arrangement, this means includes a pair of hydraulic cylinders 28 hereinafter referred to as ejection cylinders. Referring more particularly to the means for causing vertical movement of the lower crosshead, the ejection cylinders 28 are fixedly supported by the crown 16 of the press frame 12 and a pair of upwardly extending hydraulic pistons 30 are housed in the cylinders 28, the pistons 30 including upper ends joined to a press yoke 32. Tie rods 34 are fixed to the yoke 32 and extend downwardly through bores 36 in the crown 16, the tie rods 34 having lower ends fixed to the main ram cylinder body 38.

An upper plunger assembly 40 is positioned above the mold table 18 and includes an upper crosshead 42 supporting at least one downwardly extending plunger 44 adapted to be received in an upper portion of the mold cavity 20. Means are also provided for supporting the upper plunger assembly 40 for selective vertical movement with respect to the mold table 18 and with respect to the lower plunger assembly 22. While this means for causing movement of the upper plunger assembly 40 could have various constructions, in the illustrated construction it includes a main ram 45 and a pair of kicker cylinders 46. The main ram 45 includes a cylinder 48 and a ram piston having a lower end joined to the upper crosshead 42 so as to provide vertical reciprocal movement of the upper crosshead. The main ram cylinder body 38 is supported by the frame 12 for vertical reciprocal movement and is fixedly joined to the lower crosshead 24 by vertical side bar 50 such that the main ram cylinder body 38 and the lower crosshead 24 will move in unison with respect to the press frame 12 and with respect to the mold table 18. The kicker cylinders 46 each include a cylinder fixed to the main ram cylinder body 38 and a downwardly extending piston 52 having a lower end joined to the upper crosshead 42.

Figure 3:
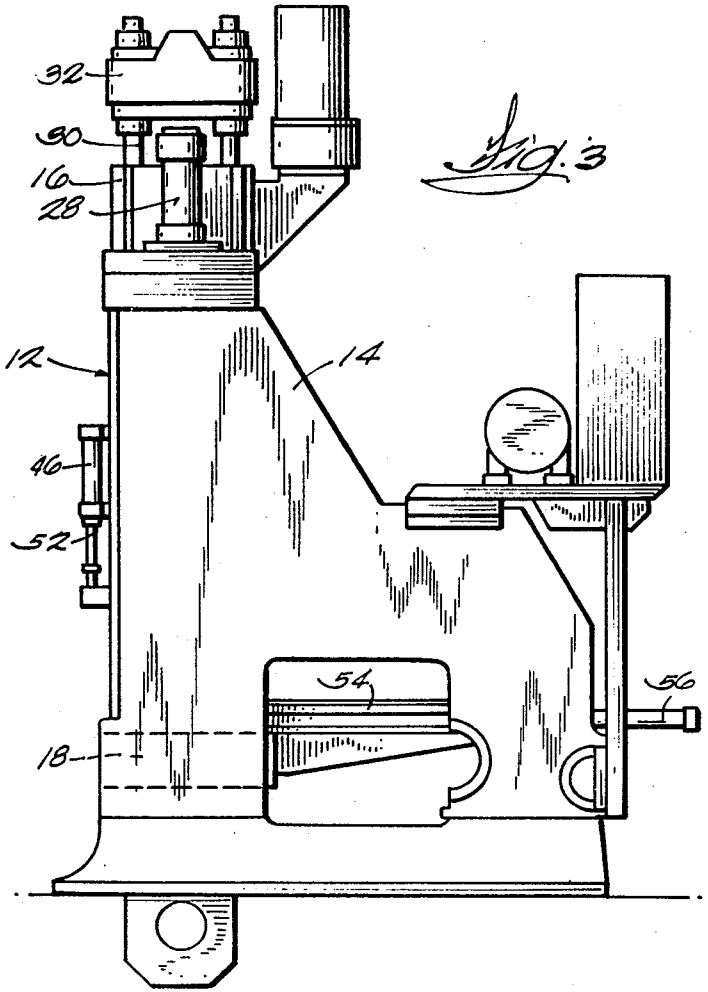
FIG. 3. is a side elevation view of the press shown in FIG. 2.
Figure 2:
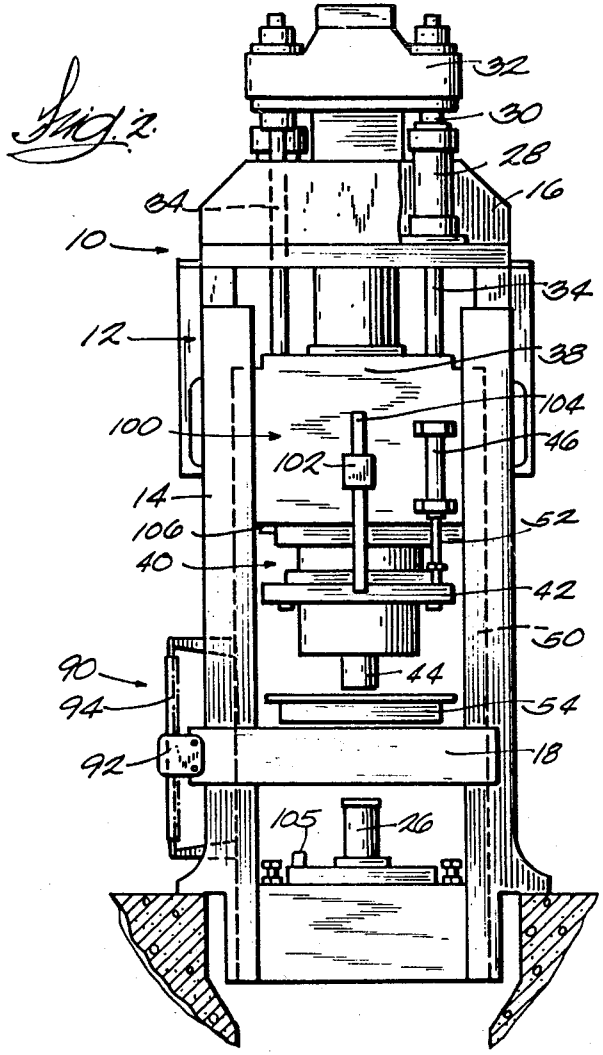
FIG. 2 is a front elevation view of the press shown in FIG. 1.

Means are also provided for depositing a selected amount or charge of refractory material in the mold cavity 20. This means includes a horizontally reciprocable charger 54, best shown in FIGS. 2 and 3. The charger 54 has a conventional construction and will not be described in detail. The charger 54 can be driven between a retracted position as shown in FIG. 3 to a forward position wherein refractory material is deposited in the mold cavity 20. The charger 54 is driven in this horizontal reciprocable manner by a horizontally positioned charger cylinder 56.

FIG. 1 further includes a schematic illustration of hydraulic circuitry which can be employed in operation of the hydraulic press 10 embodying the present invention. Since the illustrated hydraulic components are conventional, their construction and operation will not be described in detail. The illustrated hydraulic equipment includes a strokable variable volume, variable pressure pump 60 driven by a motor 62 and a similar strokable, variable volume, variable pressure pump 64 driven by a motor 66. The outputs of the pumps 60 and 64 are connected by a flow separator valve 68 to be described in greater detail hereinafter. The output of pump 60 is also connected through a kicker cylinder control valve 70 and a kicker cylinder speed control valve 72 to the kicker cylinders 46. The output of the pump 60 is also connected through a main ram control valve 74 to the cylinder 48 of the main ram. The pump 60 is also connected through a charger cylinder control valve 76 to the charger cylinder 56. The other variable volume variable pressure pump 64 is connected through ejection cylinder control valves 78 and 80 to the ejection cylinders 28. The ejection cylinders 28 are also connected to a hydraulic fluid tank 81 by a prefill valve 83, and the prefill valve 83 is operably connected to a prefill control valve 85.

In operation of the press apparatus illustrated in FIG. 1, the pressing cycle can be commenced by actuating the ejection cylinders 28 to cause upward movement of the main ram cylinder body 38 and the lower crosshead 24 such that the lower plunger 26 is positioned in the mold cavity 20, and with the upper surface of the lower plunger 26 aligned with the upper surface of the mold box of the mold table 18.

The charger 54 is then moved from its retracted position to a mold charging position by actuation of the charger cylinder 56. When the charger 54 is properly positioned over the mold cavity 20, the ejection cylinders 28 are actuated to cause downward movement of the lower plungers 26 and filling of the mold cavities with the required quantity of refractory material. The charger cylinder 56 is then actuated to cause retraction of the charger 54 to the position shown in FIG. 3.

Once the mold cavity 20 has been filled, a prefill valve 80 is actuated to cause a high volume of hydraulic fluid to flow from a tank 82 into the main ram cylinder 48, and the kicker cylinders 46 are actuated to permit downward movement of the upper crosshead 42. This provides for an initial compression or "deairing" of the refractory material in the mold cavity 20. The hydraulic circuitry can then be electrically controlled so as to maintain the upper plunger 44 in the deairing position for a predetermined period of time as selected by the operator and depending on the type of refractory product being made.

Following the deairing step, the main ram control valve 74 is actuated to cause hydraulic fluid to be provided to the main ram cylinder 48 and to thereby cause compression of the refractory material in the mold cavity 20. During this step of the operation of the press, the flow selector valve 68 can cause the output of both of the variable volume variable pressure pumps 60 and 64 to be applied to the main ram cylinder 48.

During the compression step, the ejection cylinders 28 can be controlled so as to provide only sufficient force as to support the weight of the lower crosshead 24, the upper crosshead 42, and the main ram cylinder assembly 38. If the upper and lower plunger assemblies 22 and 40 are supported by the ejection cylinders 28 in this matter, and since the main ram cylinder is fixedly connected to the lower plunger assembly 22, the lower plungers 26 will apply an upward force on the refractory material equal to the downward force on the refractory material applied by the upper plunger 44. This "floating" of the upper and lower plungers with respect to the mold table will result in generally equal compressive force being applied to both the upper and lower portions of the refractory material to thereby provide a relatively uniform density of the resultant refractory product.

Following the compression of the refractory material, the prefill valve 80 is opened to permit exit of hydraulic fluid from the main cylinder, and the kicker cylinders 46 are actuated to raise the upper crosshead 42. The ejection cylinders 28 are then actuated to cause upward movement of the lower plunger 26 so as to eject the finished brick from the mold cavity 20. The press is then in condition to repeat the operating cycle.

One of the advantages of the provisions of the pair of fluid pumps 60 and 64 and the flow separator 68 is that during parts of the press operation, the two pumps 60 and 64 can be working together, and during other parts of the press operation, the pumps 60 and 64 can be operably connected to different hydraulic elements so as to accomplish different functions. In other words, when high pressure and high volume hydraulic fluid is required, the pumps 60 and 64 can be operated together. When the press calls for high pressure and low volume, one pump can provide hydraulic fluid to one function of the press and the other pump can be coasting. During other parts of the press operation both pumps may be working independently with the flow separator 68 being closed.

Another of the features of the invention is that pressure transducers 84, 86, and 88 can be employed to provide an output of the hydraulic pressure being generated by the main ram 45, by the ejection cylinders 28, and by the kicker cylinders 46. The use of such pressure transducers can be employed, when used in combination with the hydraulic circuitry and with suitable conventional electrical control means, to provide electronic control of the press operation. The pressure transducers are also useful in that they provide the operator with a reading of the pressure being applied during the deairing step, the pressure applied during the compression step, and the pressure applied by the ejection cylinders to accomplish ejection of the bricks.

Figure 4:
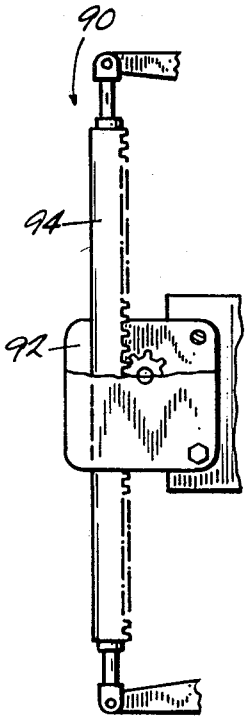
FIG. 4 is an enlarged elevation view of a vertical position sensing device embodied in the hydraulic press shown in FIG. 1–3.

As previously stated, the present invention also provides means for controlling the operation of the hydraulic rams such that the press can produce bricks having a predetermined thickness and wherein the density of the bricks can be held within finely determined limits or wherein the bricks will have a predetermined density and a size held within predetermined limits. More particularly, the means for controlling the operation of the rams includes means for sensing the relative movement of the lower plunger assembly with respect to the mold table and additional means for sensing the relative movement of the upper plunger assembly with respect to the lower plunger assembly. While various means could be provided for sensing the relative positions of the lower plunger assembly with respect to the mold table, in the illustrated arrangement, the position sensing device comprises a conventional rack and pinion position encoder 90 (FIG. 2 and 4) and includes a pinion 92 fixed to the fixed mold table 18 and a rack 94 fixed to the vertically movable side bars which are in turn supported for movement with the lower crosshead 24. It will be understood that in other arrangements the rack and pinion arrangement could be fixed to other movable portions of the press such as to the yoke 32 and the press crown 16, respectively. While the means for sensing the relative position of the upper crosshead with respect to the lower crosshead could have various construction, in the illustrated arrangement it includes a second rack and pinion position encoder 100 like the rack and pinion position encoder 90 and having a pinion 102 fixed to the main ram cylinder body 38 and a rack 104 secured at its lower end to the upper crosshead 42. In a preferred form of the invention the rack and pinion position encoders 90 and 100 each produce an electrical signal to indicate the relative position of the rack with respect to the pinion and, it is common that such conventional rack and pinion encoders 90 and 100 can indicate position or location within at least 0.001 inches.

Means are also provided for providing a signal to the encoder 90 to cause the encoder 90 to indicate a zero reference position when the lower crosshead moves to a position wherein the upper surface of the plunger 26 is flush with the upper surface of the mold box. While this means for producing an electrical signal could have various constructions, in the illustrated arrangement it comprises a proximity switch 105 supported on an upper surface of the lower crosshead 24 and engageable with the lower surface of the mold table 18 when the lower plunger 26 is flush with the upper surface of the mold box. It will be understood by those skilled in the art that the proximity switch 105 could be positioned in other convenient locations such as between the yoke 32 and the press crown 16.

Means are also provided for sending a signal to the second position encoder 100 when the upper plunger assembly 40 is in its uppermost position to cause that encoder to be reset to a zero reference. While various means could be provided to accomplish this function, in the illustrated arrangement it includes proximity switch 106 supported on the upper portion of the upper crosshead and engageable against the main ram cylinder body 38.

In operation of the above described apparatus and assuming that it is desired to produce a brick having a thickness of 3.000 inches and wherein the density of the brick is to be within predetermined limits, when the lower plunger 26 is in the raised position such that its upper surface is flush with the upper surface of the mold box and with the upper plunger assembly in its upper position, the charger 54 is moved forwardly by the charger cylinder 56. It should be noted that in this position the two position encoders 90 and 100 will each register a zero reference position. The ejection cylinders 28 are then actuated to cause downward movement of the lower plunger assembly to a position wherein the position encoder 90 registers, for example, 6.000 inches. Six inches of fill is placed in the mold cavity by the charger 54 as the plunger moves downwardly to this position. The charger 54 is then retracted by the cylinder 56.

Subsequently, the main ram 45 can force the upper crosshead 42 downwardly until the second position encoder indicates that the lower plunger 26 and the upper plunger 44 are spaced apart by a distance of 3.000 inches, and a brick having a thickness of 3.000 inches will be formed. Simultaneously, the pressure transducer 84 can emit a signal indicating the pressure in the cylinder 48. If the pressure is within suitable limits, the operator will know that the brick formed will have a suitable density. If the pressure is too low, the operator can adjust the amount of fill going into the mold cavity so that during the rest of the cycle, when the plungers are 3.000 inches apart, the brick will have a greater density. If the pressure transducer indicates a pressure higher than that which is acceptable, the operator can similarly reduce the amount of charge added to the mold cavity. In a preferred form of the invention, the amount of the charge is controlled by varying the amount of downward movement of the lower plunger assembly during the charging operation.

If it is desired to produce a brick of the required density rather than a brick having a predetermined thickness, the operator can operate the press in a density controlled or density priority manner rather than in the size priority manner referred to above. Using the density priority technique, the operator will cause the main ram to compress the refractory material in the mold cavity until a predetermined pressure is achieved, i.e., a predetermined density of the refractory material is achieved. The encoders 90 and 100 can then function to produce a readout of the thickness of the brick so formed. If the brick has a thickness which is not within a permissible range, the depth of fill during the next press cycle can be adjusted so as to provide more or less refractory material in the mold cavity.

While the operation of the above described apparatus has been referred to as being controlled on a step by step basis by the operator, it will be understood by those skilled in the art that electronic control means could be provided to control the operation of the various hydraulic valves described above, with the electronic control means receiving electrical signals from the pressure transducers 84, 86, and 88 and from the rack and pinion position encoders 90 and 100 such that the operation of the press could be automatic and electrically controlled.

Various features of the invention are set forth in the following claims.

We claim:

1. A hydraulic press comprising:

a frame, a mold box supported by said frame, said mold box including at least one vertically extending mold cavity, a lower plunger assembly positioned below said mold box and including a plunger adapted to extend upwardly into said mold cavity, an upper plunger assembly positioned above said mold box and including a plunger adapted to extend downwardly into said mold cavity, means for causing selective vertical movement of said upper plunger assembly with respect to said mold box and said lower plunger assembly, said means for causing selective movement of said upper plunger assembly including a ram and a cylinder, means for controlling movement of said upper plunger assembly and said lower plunger assembly with respect to said mold box and with respect to each other, said means for controlling movement of said upper plunger assembly and said lower plunger assembly including means for causing movement of said plunger assemblies selectively and alternatively to a position wherein there is a selected space between said plunger assemblies whereby a compressed material product produced by said press will have a selected thickness, and to a position wherein material in said mold cavity is subjected to a selected pressure between said upper plunger assembly and said lower plunger assembly whereby a compressed product produced by said press will have a selected density, said means for controlling movement including, means for sensing the relative movement of said lower plunger assembly and said upper plunger assembly, said means for sensing including means for generating a signal indicating the relative position of said upper plunger assembly and said lower plunger assembly, and means for sensing the pressure in said cylinder.

2. A hydraulic press as set forth in claim 1 wherein said means for sensing the relative movement includes a first rack and pinion position encoder including a pinion, a rack, and means for producing an electrical signal in response to relative movement of said rack and said pinion, one of said rack and said pinion being connected to said frame and the other of said rack and said pinion being connected to said lower plunger assembly.

3. A hydraulic press as set forth in claim 2 wherein said means for sensing further includes a second rack and pinion position encoder including a pinion, a rack, and means for producing an electrical signal in response to relative movement of said rack and pinion, one of said rack and pinion of said second rack and pinion being connected to said upper plunger assembly and the other of said rack and pinion of said second rack and pinion position encoder being connected to said lower plunger assembly.

4. A hydraulic press as set forth in claim 3 wherein said means for sensing the pressure in said cylinder includes a pressure transducer including means for producing an electrical signal proportional to the pressure in said cylinder.

5. A hydraulic press as set forth in claim 1 wherein said means for sensing the pressure in said cylinder includes a pressure transducer including means for producing an electrical signal proportional to the pressure in said cylinder.

6. A hydraulic press comprising a frame including a pair of spaced-apart vertical side members and a crown, a mold box rigidly supported between said vertical side members, said mold box including at least one vertically extending mold cavity, a lower plunger assembly positioned below said mold box, said lower plunger assembly including at least one plunger adapted to extend upwardly into said mold cavity, means for causing selective vertical movement of said lower plunger assembly, said means including an ejection cylinder assembly, an upper plunger assembly positioned above said mold box and including at least one upper plunger adapted to extend downwardly into said mold cavity, means for supporting said upper plunger assembly for vertical movement with respect to said mold box and with respect to said lower plunger assembly, said means for supporting including a hydraulic cylinder, means for fixedly connecting said hydraulic cylinder to said lower plunger assembly, a ram housed in said cylinder and adapted to selectively drive said upper plunger assembly downwardly, means for controlling movement of said upper plunger assembly and said lower plunger assembly with respect to said mold box and with respect to each other, said means for controlling movement of said upper plunger assembly and said lower plunger assembly including means for causing movement of said plunger assemblies selectively and alternatively to a position wherein there is a selected space between said plunger assemblies whereby a compressed material product produced by said press will have a selected thickness, and to a position wherein material in said mold cavity is subjected to a selected pressure between said upper plunger assembly and said lower plunger assembly whereby a compressed product produced by said press will have a selected density, said means for controlling movement including, means for sensing the relative movement of said lower plunger assembly and said upper plunger assembly, said means for sensing including means for generating a signal indicating the relative position of said upper plunger assembly and said lower plunger assembly, and means for sensing the pressure in said cylinder.

7. A hydraulic press as set forth in claim 6 wherein said means for sensing the relative movement includes a first rack and pinion position encoder including a pinion, a rack, and means for producing an electrical signal in response to relative movement of said rack and pinion, one of said rack and said pinion being connected to said frame and the other of said rack and said pinion being connected to said lower plunger assembly.

8. A hydraulic press as set forth in claim 7 wherein said means for sensing further includes a second rack and pinion position encoder including a pinion, a rack, and means for producing an electrical signal in response to relative movement of said rack and pinion, one of said rack and pinion of said second rack and pinion being connected to said upper plunger assembly and the other of said rack and pinion of said second rack and pinion position encoder being connected to said hydraulic cylinder.

9. A hydraulic press as set forth in claim 8 wherein said means for sensing the pressure in said cylinder includes a pressure transducer including means for producing an electrical signal proportional to the pressure in said cylinder.

10. A hydraulic press as set forth in claim 6 wherein said means for sensing the pressure in said cylinder includes a pressure transducer including means for producing an electrical signal proportional to the pressure in said cylinder.

11. A hydraulic press comprising a frame including a pair of spaced-apart vertical side members and a crown, a mold box rigidly supported between said vertical side members, said mold box including at least one vertically extending mold cavity, a lower plunger assembly positioned below said mold box, said lower plunger assembly including a lower crosshead and at least one plunger supported by said lower crosshead and adapted to extend upwardly into said mold cavity, means for causing selective vertical movement of said lower crosshead, said means including an ejection cylinder assembly supported by said crown, an upper plunger assembly positioned above said mold box and including an upper crosshead and at least one upper plunger supported by said crosshead and adapted to extend downwardly into said mold cavity, means for supporting said upper crosshead for vertical movement with respect to said mold box and said lower crosshead including a hydraulic cylinder, means for fixedly connecting said hydraulic cylinder to said lower crosshead, a ram housed in said cylinder and adapted to selectively drive said upper crosshead downwardly, means for controlling movement of said upper plunger assembly and said lower plunger assembly with respect to said mold box and with respect to each other, said means for controlling movement of said upper plunger assembly and said lower plunger assembly including means for causing movement of said plunger assemblies selectively and alternatively to a position wherein there is a selected space between said plunger assemblies whereby a compressed material product produced by said press will have a selected thickness, and to a position wherein material in said mold cavity is subjected to a selected pressure between said upper plunger assembly and said lower plunger assembly whereby a compressed product produced by said press will have a selected density, said means for controlling movement including, means for sensing the relative movement of said lower plunger assembly and said upper plunger assembly, said means for sensing including means for generating a signal indicating the relative position of said upper plunger assembly and said lower plunger assembly, and means for sensing the pressure in said cylinder.

12. A hydraulic press as set forth in claim 1 wherein said means for sensing the relative movement includes a first rack and pinion position encoder including a pinion, a rack, and means for producing an electrical signal in response to relative movement of said rack and pinion, one of said rack and said pinion being connected to said frame and the other of said rack and said pinion being connected to said lower plunger assembly.

13. A hydraulic press as set forth in claim 12 wherein said means for sensing further includes a second rack and pinion position encoder including a pinion, a rack, and means for producing an electrical signal in response to relative movement of said rack and pinion, one of said rack and pinion of said second rack and pinion being connected to said upper plunger assembly and the other of said rack and pinion of said second rack and pinion position encoder being connected to said lower plunger assembly.

14. A hydraulic press as set forth in claim 13 wherein said means for sensing the pressure in said cylinder includes a pressure transducer including means for producing an electrical signal proportional to the pressure in said cylinder.

15. A hydraulic press as set forth in claim 11 wherein said means for sensing the pressure in said cylinder includes a pressure transducer including means for producing an electrical signal proportional to the pressure in said cylinder.

16. A hydraulic press comprising:

a frame, a mold box supported by said frame, said mold box including at least one vertically extending mold cavity, a lower plunger assembly positioned below said mold box and including a plunger adapted to extend upwardly into said mold cavity, an upper plunger assembly positioned above said mold box and including a plunger adapted to extend downwardly into said mold cavity, means for causing selective vertical movement of said upper plunger assembly with respect to said mold box and said lower plunger assembly, said means for causing selective movement of said upper plunger assembly including a ram and a cylinder, means for sensing the relative movement of said lower plunger assembly and said upper plunger assembly, said means for sensing including means for generating a signal indicating the relative position of said upper plunger assembly and said lower plunger assembly, and means for sensing the pressure in said cylinder, said means for sensing the relative movement including a first rack and pinion position encoder including a pinion, a rack, and means for producing an electrical signal in response to relative movement of said rack and said pinion, one of said rack and said pinion being connected to said frame and the other of said rack and said pinion being connected to said lower plunger assembly, said means for sensing further including a second rack and pinion position encoder including a pinion, a rack, and means for producing an electrical signal in response to relative movement of said second rack and pinion, one of said rack and pinion of said second rack and pinion being connected to said upper plunger assembly and the other of said rack and pinion of said second rack and pinion position encoder being connected to said lower plunger assembly.

17. A hydraulic press comprising a frame including a pair of spaced-apart vertical side members and a crown, a mold box rigidly supported between said vertical side members, said mold box including at least one vertically extending mold cavity, a lower plunger assembly positioned below said mold box, said lower plunger assembly including at least one plunger adapted to extend upwardly into said mold cavity, means for causing selective vertical movement of said lower plunger assembly, said means including an ejection cylinder assembly, an upper plunger assembly positioned above said mold box and including at least one upper plunger adapted to extend downwardly into said mold cavity, means for supporting said upper plunger assenbly for vertical movement with respect to said mold box and with respect to said lower plunger assembly, said means for supporting including a hydraulic cylinder, means for fixedly connecting said hydraulic cylinder to said lower plunger assembly, a ram housed in said cylinder and adapted to selectively drive said upper plunger assembly downwardly, means for sensing the relative movement of said lower plunger assembly and said upper plunger assembly, said means for sensing including means for generating a signal indicating the relative position of said upper plunger assembly and said lower plunger assembly, and means for sensing the pressure in said cylinder, said means for sensing the relative movement including a first rack and pinion position encoder including a pinion, a rack, and means for producing an electrical signal in response to relative movement of said rack and pinion, one of said rack and said pinion being connected to said frame and the other of said rack and said pinion being connected to said lower plunger assembly, said means for sensing further including a second rack and pinion position encoder including a pinion, a rack, and means for producing an electrical signal in response to relative movement of said second rack and pinion, one of said rack and pinion of said second rack and pinion being connected to said upper plunger assembly and the other of said rack and pinion of said second rack and pinion position encoder being connected to said hydraulic cylinder.

18. A hydraulic press comprising a frame including a pair of spaced-apart vertical side members and a crown, a mold box rigidly supported between said vertical side members, said mold box including at least one vertically extending mold cavity, a lower plunger assembly positioned below said mold box, said lower plunger assembly including a lower crosshead and as least one plunger supported by said lower crosshead and adapted to extend upwardly into said mold cavity, means for causing selective vertical movement of said lower crosshead, said means including an ejection cylinder assembly supported by said crown, an upper plunger assembly positioned above said mold box and including an upper crosshead and at least one upper plunger supported by said crosshead and adapted to extend downwardly into said mold cavity, means for supporting said upper crosshead for vertical movement with respect to said mold box and said lower crosshead including a hydraulic cylinder, means for fixedly connecting said hydraulic cylinder to said lower crosshead, a ram housed in said cylinder and adapted to selectively drive said upper crosshead downwardly, means for sensing the relative movement of said plunger assembly and said upper plunger assembly, said means for sensing including means for generating a signal indicating the relative position of said upper plunger assembly and said lower plunger assembly, and means for sensing the pressure in said cylinder, said means for sensing the relative movement including a first rack and pinion position encoder including a pinion, a rack, and means for producing an electrical signal in response to relative movement of said rack and pinion, one of said rack and said pinion being connected to said frame and the other of said rack and said pinion being connected to said lower plunger assembly, said means for sensing further including a second rack and pinion position encoder including a pinion, a rack, and means for producing an electrical signal in response to relative movement of said second rack and pinion, one of said rack and pinion of said second rack and pinion being connected to said upper plunger assembly and the other of said rack and pinion of said second rack and pinion position encoder being connected to said lower plunger assembly.

* * * * *